US007093597B2

(12) United States Patent
Taieb

(10) Patent No.: US 7,093,597 B2
(45) Date of Patent: Aug. 22, 2006

(54) RESPIRATORY EQUIPMENT

(76) Inventor: Denis Taieb, 153 S. Swall Dr., Beverly Hills, CA (US) 90211

( * ) Notice: Subject to any disclaimer, the term of this patent is extended or adjusted under 35 U.S.C. 154(b) by 0 days.

(21) Appl. No.: 10/126,323

(22) Filed: Apr. 19, 2002

(65) Prior Publication Data

US 2003/0196665 A1 Oct. 23, 2003

(51) Int. Cl.
*A62B 18/08* (2006.01)
*A62B 18/02* (2006.01)

(52) U.S. Cl. ..... 128/206.27; 128/205.25

(58) Field of Classification Search ..... 128/206.27, 128/205.25, 201.25, 201.22, 201.23, 201.24; 206/470, 438; 244/118.5
See application file for complete search history.

(56) References Cited

U.S. PATENT DOCUMENTS 4,154,237 A * 5/1979 Courter ..... 128/206.27
4,481,945 A * 11/1984 Levine ..... 128/206.27
4,625,721 A * 12/1986 Levine et al. ..... 128/201.28
4,664,108 A * 5/1987 Ansite ..... 128/202.26
4,669,462 A * 6/1987 Marshall ..... 128/205.25
4,677,976 A * 7/1987 Fujinuma et al. ..... 128/201.25
4,766,893 A * 8/1988 Drews ..... 128/201.29
4,909,247 A * 3/1990 Terrisse et al. ..... 128/206.27
5,003,974 A * 4/1991 Mou ..... 128/201.25
5,078,343 A * 1/1992 Howlett ..... 244/118.5
5,115,804 A * 5/1992 Brookman ..... 128/201.22
5,301,665 A * 4/1994 Jumpertz et al. ..... 128/202.26
5,343,859 A * 9/1994 Kikut ..... 128/205.13
5,503,147 A 4/1996 Bertheau
5,664,566 A 9/1997 McDonald et al.
5,666,949 A * 9/1997 Debe et al. ..... 128/202.22
5,954,052 A * 9/1999 McDonald et al. .... 128/206.27
6,039,045 A 3/2000 Bertheau et al.
6,070,580 A * 6/2000 McDonald et al. .... 128/207.11
6,089,230 A * 7/2000 Barker et al. ..... 128/204.29
6,247,471 B1 * 6/2001 Bower et al. ..... 128/205.21
6,318,364 B1 * 11/2001 Ford et al. ..... 128/204.18
6,336,667 B1 * 1/2002 Ford et al. ..... 292/25
6,425,394 B1 * 7/2002 Weinstein et al. ..... 128/200.24
6,526,967 B1 * 3/2003 Cordero et al. ..... 128/200.24

FOREIGN PATENT DOCUMENTS

GB 2238480 A * 6/1991

* cited by examiner

*Primary Examiner*—Henry Bennett
*Assistant Examiner*—Andrea M. Ragonese
(74) *Attorney, Agent, or Firm*—Dean W. Russell; Kilpatrick Stockton LLP

(57) ABSTRACT

Respiratory apparatus including stowage equipment is addressed. The equipment may include a non-rigid bag covering at least part of an oxygen mask. The bag additionally may have an opening through which a portion of the mask protrudes, thereby facilitating its grasping and rapid donning by a user.

5 Claims, 4 Drawing Sheets

RESPIRATORY EQUIPMENT

FIELD OF THE INVENTION

This invention relates generally to respiratory equipment and more particularly to housings adapted to facilitate rapid donning of respiratory masks, typically (but not exclusively) by aircraft crewmembers.

BACKGROUND OF THE INVENTION

U.S. Pat. No. 6,039,045 to Bertheau, et al., incorporated herein in its entirety by this reference, discloses an exemplary respiratory mask and an associated box or housing. As noted in the Bertheau patent: "As the cruising altitude of passenger and business airplanes increases, it becomes more and more difficult to protect the crew members against a sudden depressurization." See Bertheau, col. 1, 11.

16–18. Consequently, harnesses for respiratory masks have been developed which may be stored in a box in close proximity to the seat and may be grasped by the user with one hand and donned in a time as short as some seconds. However, if depressurization occurs at a very high altitude, lack of oxygen due to exposure to vacuum during some seconds may be sufficient for causing a delayed temporary loss of consciousness after which it will be too late for the pilot to resume aircraft control.

See id., 11. 37–44.

The Bertheau patent thus describes equipment including a mask harness which, among other features, "lowers the time period following pressurization failure before respiratory oxygen is available to the user." See id., 11. 59–61. Illustrated in FIG. 1A of the Bertheau patent is an exemplary storage box for the harness. Because of space restrictions in cockpits of many aircraft, often these storage boxes are sized to be only slightly larger than the dimensions of the associated mask (and uninflated harness), thus lacking room for many "full-face" masks combining both oxygen regulators and goggles.

U.S. Pat. No. 5,664,566 to McDonald, et al., also incorporated herein in its entirety by this reference, illustrates one such full-face assembly. The McDonald patent attempts to describe a supposed solution to this issue by utilizing so-called "flexible" lenses and seals so that "the mask may be rolled" for storage in a small(er), boxy container. See McDonald, col. 5, 11. 18–22. Such a container is illustrated, at least generally, in FIG. 3 of the McDonald patent.

SUMMARY OF THE INVENTION

The present invention provides respiratory apparatus including storage equipment unlike the boxes presently in use. Although the apparatus may incorporate features of existing stowage boxes, it additionally may comprise a non-rigid bag covering at least part of a full-face type mask. Typically (although not necessarily) made of fabric, preferred bags will be attached to upper parts of associated boxes and contain lateral openings through which mask assemblies may protrude. By appropriately orienting the protruding portions, the masks may be positioned to facilitate their rapid donning by aircrew personnel.

Bags of the present invention further may include one or more repositionable flaps to facilitate donning and stowage of the masks. Preferably hook-and-loop (e.g. Velcro) fasteners are used to attach the flaps to the remainder of the bags, with the fastening strength being sufficiently low as not to impede significantly a user from removing the mask for use.

Indeed, a user's grasping the mask and pulling it from the housing is expected readily to cause the components of the hook-and-loop fasteners to disengage, thus freeing the mask from the bag for donning. Upon returning the mask for stowage, the user need merely position the mask appropriately and then reconnect the components of the fasteners to provide a snug enclosure for the mask.

Stowage equipment of the present invention also may include a pneumatic assembly with suitable supply and outlet hoses and valving. In some embodiments of the equipment, the pneumatic assembly is installed in the bag with a mounted bracket so as to allow a flow indicator to protrude therefrom to make it visible to crew members. The equipment additionally may be adapted to fit into the console space currently allocated for the solely rigid boxes so that, if desired, aircraft may be retrofitted.

It thus is an object of the present invention to provide storage equipment for respiratory apparatus equipped with a face seal of a full-face mask.

It is also an object of the present invention to provide storage equipment including a bag adapted snugly to enclose at least part of the respiratory apparatus.

It is a further object of the present invention to provide storage equipment in which the bag includes a lateral opening through which at least part of the respiratory apparatus may protrude.

It is an additional object of the present invention to provide storage equipment with one or more repositionable flaps whose fastening components may be caused to separate when a mask of the respiratory equipment is pulled from the bag.

It is another object of the present invention to provide a pneumatic assembly attached to the storage equipment so as to permit a flow indicator to protrude therefrom.

Other objects, features, and advantages of the present invention will be apparent to those skilled in the relevant art with reference to the remaining text and the drawings of this application.

DETAILED DESCRIPTION

Figure 1:
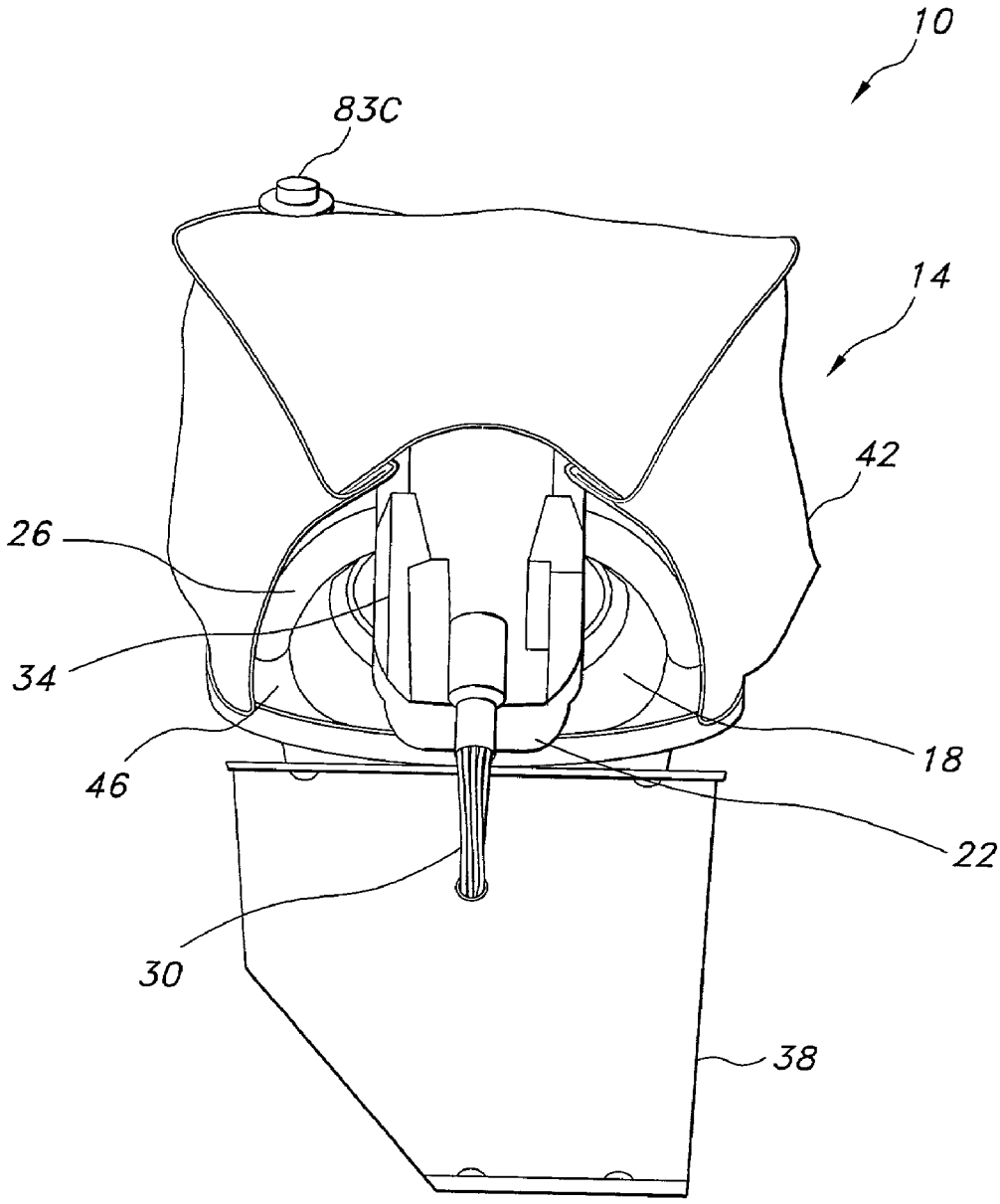
FIG. 1 is a front elevational view of exemplary respiratory equipment including a full-face respiratory mask and a housing or container therefor.
Figure 2:
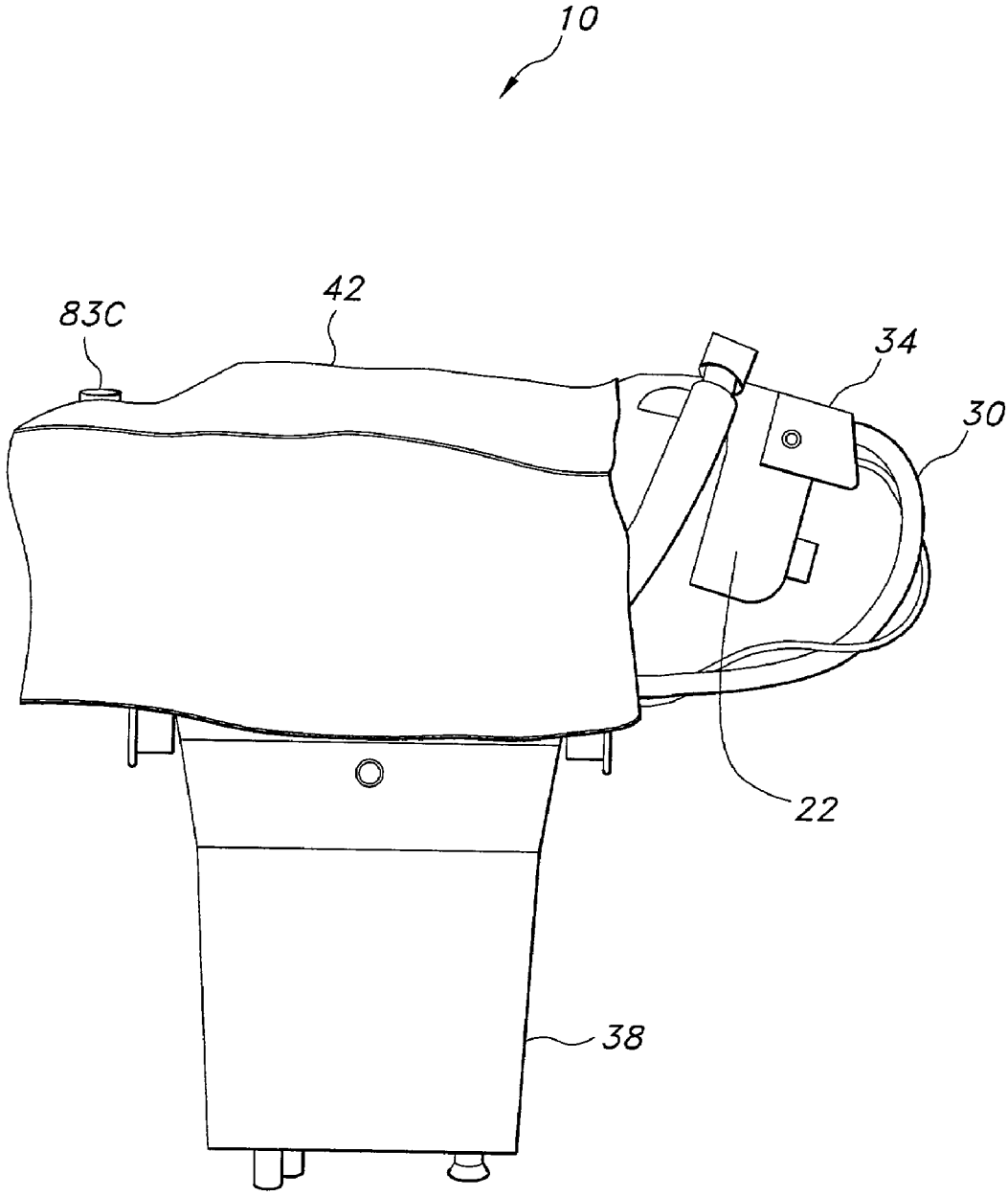
FIG. 2 is a side elevational view of the equipment of FIG. 1.
Figure 3:
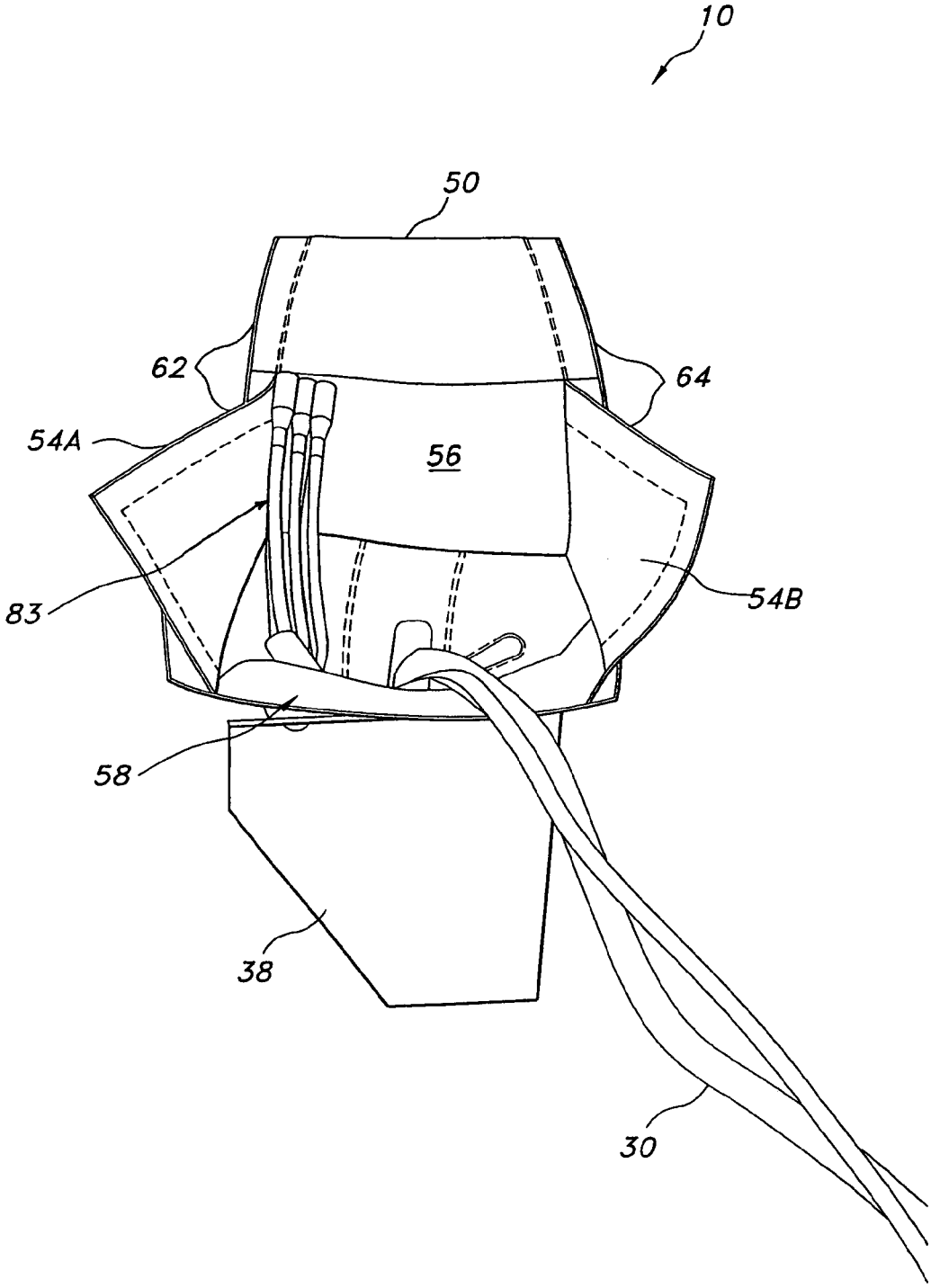
FIG. 3 is a view similar to FIG. 1 but with the mask removed from the housing (as, for example, for use).
Figure 4D:
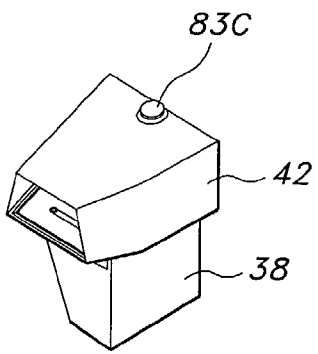
FIGS. 4A–D are views showing aspects of the housing of FIG. 1.
Figure 4B:
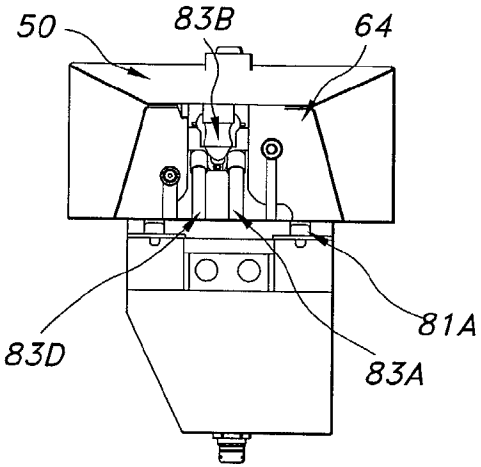
Figure 4C:
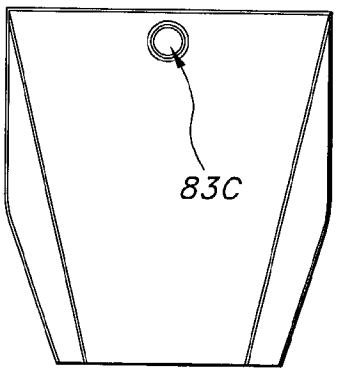
Figure 4A:
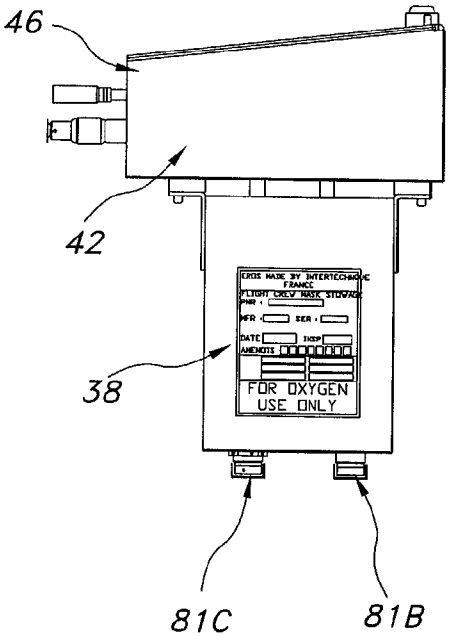

FIGS. 1–3 detail equipment 10 of the present invention. Equipment 10 includes housing 14 and mask 18, the latter of which is of the full-face variety. Depicted in FIGS. 1–2 are portions of oxygen regulator 22 and (inflatable) harness 26 together with regulator supply hose 30. Such components may be similar to the regulator, harness, and supply hose of the Bertheau patent, for example, or to the corresponding components identified in the McDonald patent. They need not be so limited, however, as those skilled in the relevant art will recognize that numerous other regulation equipment, harnesses or straps (whether inflatable or not), and hoses or tubes may be satisfactorily employed.

Additionally illustrated in FIGS. 1–2 are tabs or paddles 34, described as "ears" in the Bertheau patent. These paddles 34, when depressed, actuate a control valve permitting pressurized respiratory gas to inflate harness 26. Paddles 34 further typically constitute the means by which a user grasps mask 18 to remove it from housing 14.

As detailed in FIGS. 1–3, housing 14 may comprise container 38 and bag 42. Container 38 and bag 42 typically are connected in some manner to form a single unit. Screws, bolts, or any other suitable fasteners may be used to attached the two together.

Container 38 preferably is comprised of metal, hard plastic, or other relatively rigid material and may be adapted to fit into the instrument console of an aircraft cockpit. Bag 42, by contrast, is preferably formed of a flexible material, such as soft fabric, able to conform (at least to reasonable extent) to the general shape of mask 18. FIGS. 1–2 illustrate bag 42 as so conformed, so that bag 42 covers much of mask 18.

Typically, however, bag 42 is designed with lateral opening 46 through which a portion of mask 18 protrudes. In particular, paddles 34 advantageously protrude through opening 46 and thus are immediately accessible to a wearer of mask 18. With this arrangement, no part of either bag 42 or container 38 impedes access to paddles 34.

Depicted especially in FIG. 3 are flap 50, side walls 54A–B, rear wall 56, and base 58 of bag 42. Base 58 preferably constitutes the portion of bag 42 fixed to container 38 and may include one or more openings through which supply hose 30 and other hoses, tubes, connectors, or other equipment extend. Flap 50 may be integrally formed with or sewn or otherwise attached to rear wall 56, preferably (although not necessarily) so as to be inseparable therefrom. By contrast, flap 50 typically is designed to separate from side walls 54A–B (as illustrated in FIG. 3); hence, connection of flap 50 and side walls 54A–B desirably is made with a non-permanent, re-engageable fastening mechanism. One such mechanism comprises hook-and-loop fasteners 62 and 64, with strips of either hooks or loops affixed along appropriate edges of each of flap 50, side wall 54A, and side wall 54B. Those skilled in the art will, of course, recognize that alternative fasteners may be employed instead.

When the hooks and loops of fasteners 62 and 64 are engaged, bag 42 appears as shown in FIGS. 1–2, snugly enclosing the bulk of mask 18. To utilize the mask 18, a wearer may simply grasp the protruding mask 18 (preferably using—and thereby depressing—paddles 34 so as immediately to inflate harness 26) and pull the mask away from bag 42 (i.e. out of the plane of the page of FIG. 1). Doing so provides enough force to cause the hooks and loops of fasteners 62 and 64 to disengage, thus separating flap 50 from side walls 54A–B (as shown in FIG. 2). Not only does this result prevent bag 42 from impeding removal of mask 18 to any significant extent, it also facilitates reinsertion of the mask 18 into housing 14 after use.

FIGS. 4A–D detail, somewhat schematically, additional features of embodiments of equipment 10. System 81A may, for example, be quarter-turn fastening apparatus designed to attach equipment 10 to a console, while connectors 81B and 81C allow connection to a respiratory gas supply and electrical supply (to power a microphone), respectively. Any suitable fasteners and connectors may be used, however. To retrofit an aircraft console with equipment 10, the existing stowage box may be removed and disconnected from the cockpit gas and electrical supply lines, those lines connected to connectors 81B and 81C, respectively, and equipment 10 affixed in position in the console using system 81A.

Additionally detailed in FIGS. 3 and 4A–D is a pneumatic assembly 83, comprising some or all of supply hose 83A, valve 83B, flow indicator 83C, and outlet hose 83D (for connection to regulator supply hose 30). In preferred embodiments of equipment 10, assembly 83 is installed in bag 42 using a mounting bracket, with flow indicator 83C protruding through flap 50 and visible externally of the bag 42. In this manner, a user (or others) may visually determine whether respiratory gas is flowing to mask 18 merely by examining flow indicator 83C. Those skilled in the art understand assembly 83 need not be installed in exactly this manner, however, but rather may be incorporated in any desirable way as part of equipment 10.

The foregoing is provided for purposes of illustrating, explaining, and describing exemplary embodiments of the present invention. Modifications and adaptations to the illustrated and described embodiments will be apparent to those skilled in the relevant art and may be made without departing from the scope or spirit of the invention. As a non-limiting example of a possible adaptation, applicants note that embodiments of equipment 10 may include as part of assembly 83 a valve activated automatically when mask 18 is removed from bag 42. Likewise, a microphone included as part of mask 18 may be activated automatically when the mask 18 is deployed. Further, equipment 10 may be positioned within aircraft other than in cockpits, permitting its use by non-pilot crew and passengers; additionally, if appropriately modified, equipment 10 may be utilized in vehicles other than aircraft, in buildings, or as stand-alone or portable breathing apparatus.

What is claimed is:

1. Housing for stowing respiratory equipment, comprising:
   a. generally rigid container; and
   b. a flexible bag attached to the container and comprising:
      i. at least one repositionable flap; and
      ii. at least one side wall to which the flap is removably fastened using a fastener, with the act of pulling the respiratory equipment from the bag disengaging the fastener to cause the flap and side wall to separate.

2. A flexible bag for a respiratory mask, comprising:
   a. a base;
   b. a rear wall and at least one side wall, each connected to or formed with the base;
   c. a flap connected to or formed with the base; and
   d. at least one fastener for connecting the flap with the at least one side wall, so as snugly to enclose at least a first portion of the respiratory mask when the respiratory mask is stowed.

3. A flexible bag according to claim 2 defining an opening through which a second portion of the respiratory mask protrudes when the respiratory mask is stowed.

4. Respiratory equipment comprising:
   a. a full-face oxygen mask comprising:
      i. a regulator; and
      ii. at least one paddle for activating flow of oxygen through the regulator;
   b. a rigid box adapted for connection within a console of an aircraft cockpit; and
   c. a flexible bag attached directly to the box and snugly enclosing a portion of the mask for stowage, the bag comprising:
      i. a repositionable flap; and
      ii. an opening through which the paddle protrudes.

5. A method for deploying a respiratory mask, comprising:

a. providing a housing for stowing the mask, the housing (i) formed at least in part of flexible material, (ii) including a flap, and (iii) having an opening through which a portion of the mask protrudes;

b. grasping the protruding portion of the mask; and c. pulling the mask away from the housing, thereby separating the flap from at least part of the remainder of the housing.

* * * * *